United States Patent [19]

Carlin

[11] 4,053,376

[45] Oct. 11, 1977

[54] ELECTROLYTIC PRODUCTION OF HYDROGEN IODIDE

[75] Inventor: William W. Carlin, Portland, Tex.

[73] Assignee: PPG Industries, Inc., Pittsburgh, Pa.

[21] Appl. No.: 735,867

[22] Filed: Oct. 27, 1976

[51] Int. Cl.[2] ..... C25B 1/22; C25B 1/24

[52] U.S. Cl. ..... 204/103

[58] Field of Search ..... 204/103, 101, 128, 180 P

[56] References Cited

U.S. PATENT DOCUMENTS

| | | | |
|---|---|---|---|
| 448,541 | 3/1891 | Parker et al. | 204/128 |
| 3,165,460 | 1/1965 | Zang et al. | 204/301 |
| 3,726,937 | 4/1973 | Stepanoy et al. | 204/128 |
| 3,761,579 | 9/1973 | Curtis et al. | 423/486 |
| 3,787,304 | 1/1974 | Chlanda et al. | 204/180 P |
| 3,848,065 | 11/1974 | Paulik | 423/487 |

*Primary Examiner*—R. L. Andrews
*Attorney, Agent, or Firm*—Richard M. Goldman

[57] ABSTRACT

Disclosed is a method of producing aqueous iodide solutions. According to the disclosed method, iodine is electrolyzed in an aqueous catholyte and hydrogen iodide is formed.

12 Claims, 1 Drawing Figure

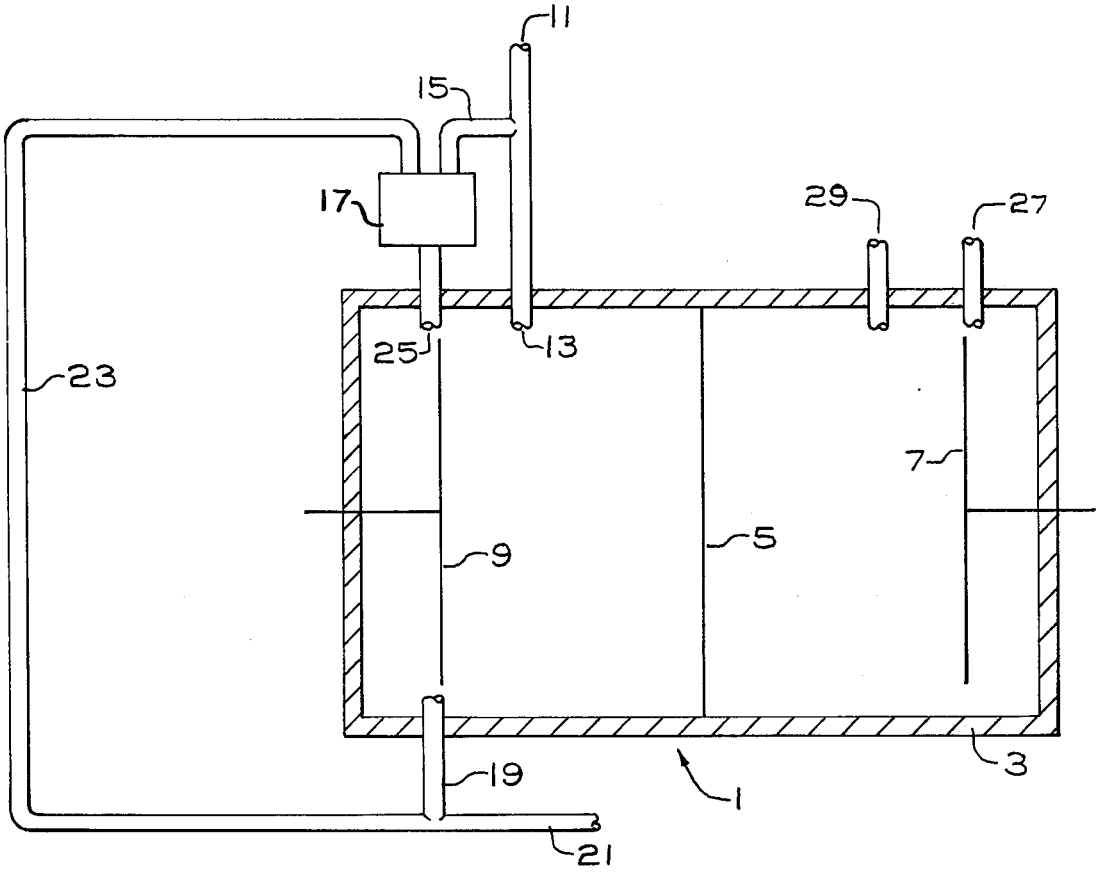
11
15
17
29
27
25
13
23
7
9
5
19
3
1
21

ELECTROLYTIC PRODUCTION OF HYDROGEN IODIDE

DESCRIPTION OF THE INVENTION

Aqueous solutions of hydrogen iodide find use as antiseptics, water disinfectants, and the like. Particularly preferred are aqueous solutions of hydrogen iodide containing from about 40 to about 50 or more weight percent hydrogen iodide and small amounts of iodine.

Aqueous hydrogen iodide solutions have generally been prepared by the reaction of hydrogen and iodine over platinum catalysts or by the reaction of hydrogen sulfide with iodine in water.

It has now been found that aqueous iodide solutions, for example, aqueous hydrogen iodide solutions, can be produced electrolytically in an electrolyte cell by feeding iodine to an aqueous catholyte liquor, passing current from an anode through an electrically conductive anolyte liquor, a diaphragm or membrane, and an electrically conductive catholyte liquor to the cathode, and evolving the iodide in the catholyte .

Preferably, a permionic membrane rather than a permeable diaphragm is interposed between the anolyte liquor and the catholyte liquor. Hydrogen iodide may be present in the catholyte liquor at start-up to provide some solubility for the iodine.

The anolyte itself is preferably an aqueous solution of an acid so that hydrogen ion can pass through the membrane from the anolyte to the catholyte and an anodic co-product such as chlorine or oxygen is provided.

THE FIGURE

The FIGURE shows a schematic view of an electrolytic cell divided into an anolyte compartment and a catholyte compartment by a permionic membrane. The electrolyte cell further shows anolyte feed means, anolyte gas recovery means, and catholyte liquor recovery means.

DETAILED DESCRIPTION OF THE INVENTION

Hydrogen iodide is produced in an electrolytic process yielding an aqueos solution of hydroiodic acid. Additionally, the aqueous solution of hydroiodic acid may include small amounts of iodine, e.g., iodide ion, $I_3^{31}$, in the acid. Preferably, the hydroiodic acid solution contains in excess of 40 weight percent hydrogen iodide, for example, as much as 46 to 50 or even 55 weight percent hydroiodic acid.

The electrolytic process is carried out in electrolytic cell 1 having an anolyte chamber containing an anode 7 separated from a catholyte chamber containing a cathode 9 by a permionic membrane 5. The permionic membrane will be described more fully hereinafter.

According to the method described herein, an aqueous catholyte liquor is provided. In the operation of a continuous process, a solubilizing amount of hydrogen iodide will be present in the catholyte liquor. However, in a batch process or semi-batch process, the addition of some hydrogen iodide, for example, a solubilizing amount of hydrogen iodide, may be necessary. The concentration of hydrogen iodide in the catholyte liquor after the process has been carried out for some time is a function of the residence time in the catholyte chamber. Frequently, the concentration of hydrogen iodide is in excess of 40 percent, for example, as high as 46 or 50 or even 55 weight percent.

The concentration of iodine in the catholyte liquor is generally below the solubility limit thereof. However, during start-up of a batch process, the concentration of iodine may be at the solubility limit. The solubility limit of the iodine is a function of the hydrogen iodide concentration as will be more fully described hereinafter. Additionally, iodine may be present as a solid within the catholyte chamber, for example, at the start of a batch or semi-batch process.

The saturation concentration of iodine, in grams per liter, is approximately equal to the actual concentration of hydrogeniodide in the aqueous solution, in grams per liter. The values shown in Table I have been reported in the literature for the saturation concentrations of iodine in hydrogen iodide solutions at 25° C. in gram moles per liter.

TABLE I

Solubility of Iodine in Aqueous Hydroiodic Acid
Gram moles per liter

| HI | $I_2$ |
|---|---|
| 0.0000 | 0.0029 |
| 0.0604 | 0.0295 |
| 0.0922 | 0.0459 |
| 0.1209 | 0.0619 |
| 0.2110 | 0.1117 |
| 0.3120 | 0.1633 |
| 0.1230 | 0.2358 |
| 0.5000 | 0.3000 |
| 0.6350 | 0.3950 |

A "solubilizing amount" of hydrogen iodide is an amont sufficient to provide the desired concentration of iodine in the solution.

An aqueous, electrically conductive anolyte liquor is provided in the anolyte chamber. The anolyte liquor should have an electrical conductivity of greater than about 0.03 $(\text{ohm-cm})^{-1}$ and preferably greater than about 1.0 $(\text{ohm-cm})^{-1}$ at a temperature of about 25° C. The electrical conductivity may be higher or lower than the above values depending upon the temperature and the presence or absence of various impurities with deleterious effects.

The anolyte liquor may be provided by an acidic aqueous solution, for example, sulfuric acid, hydrochloric acid, or phosphoric acid. Where the anolyte liquor is provided by an aqueous solution of acid, the acid should preferably be an acid having a useful anodic co-product. Typical acids yielding a co-product include sulfuric acid having oxygen as a co-product, phosphoric acid having oxygen as a co-product and hydrochloric acid having chlorine as a co-product. The concentration of the acid should be such as to provide an economical electrical conductivity of the anolyte liquor. Additionally, it may be desirable to minimize water transport from the anolyte to the catholyte, for example, by utilizing a concentrated anolyte liquor. The concentration of the anolyte is a matter of routine experimentation depending upon the design of the cell, the temperature of the electrolyte, the quantity and identity of the impurities in the anolyte, and the desired strength of the iodide solution.

Where the anolyte liquor is sulfuric acid, the concentration thereof is from about 5 to about 40 weight percent and preferably from about 10 to about 35 weight percent, although the concentration thereof may be optimized by routine experimentation. Where the electrolyte is hydrochloric acid, the concentration thereof may be about 2 weight percent to a saturated solution, e.g., about 38 weight percent, and preferably from about 5 weight percent to about 38 weight percent.

While it is preferred that the anolyte liquor be an acid so as to provide the migration of hydrogen ions through the permionic membrane, the anolyte liquor may also be a salt where the anodic co-product is as described above and the cathodic product of the process is an iodide salt.

Electrical current is passed through the cell with iodine present in the catholyte liquor. The process may be operated as a batch process, semi-batch process, or a continuous process. When operated as a batch process, iodine, either in solution or as a solid in a saturated solution, is added to the catholyte liquor. A solubilizing amount of hydrogen iodide is preferably present in the catholyte liquor, e.g., about 7 grams per liter of hyrogen iodide, provides an iodine content in the solution of about 7 grams per liter. As more hydrogen iodide is formed, more of the solid iodine will be solubilized.

According to an alternative exemplification of this invention, the process may be operated in one of the two semi-batch methods. According to one semi-batch method, solid iodine is added to the catholyte liquor at the beginning of the run and hydrogen iodide is continuously removed from the catholyte chamber to keep the hydrogen iodide and iodine contents of the catholyte liquor at the desired level. At high hydrogen iodide contents, for example, above about 40 weight percent, the iodine concentration may be and preferably is below the saturation amount.

In an alternative semi-batch method of operation, solid iodine is slowly added to the catholyte liquor while building up the hydrogen iodide concentration thereof, for example, by starting out with about 0.3 grams per liter or less of iodine and feeding more iodine as the hydrogen iodide concentration of the catholyte liquor builds up. Thereafter, either sufficient iodine may be added to keep the iodine concentration at a desired level until a desired hydrogen iodide strength is attained or the catholyte iodine can be depleted as the hydrogen iodide strength builds up.

In the continuous mode of operation, a stoichiometric amount of iodine may be added to the catholyte liquor and the concentration of hydrogen iodide maintained at the desired strength, e.g., at about 40 to 55 weight percent hydrogen iodide, such that no solid iodine is present in the catholyte. Where the process is operated continuously, the concentration of hydrogen iodide, after start up, is frequently in excess of 40 weight percent, for example, 46 or 50 or even 55 weight percent hydrogen iodide and the concentration of iodine may be much lower, for example, as low as 2, 3, 5 or 10 percent. The concentration of iodine should be high enough, however, to avoid the formation of hydrogen.

The iodine may be added as a solid or in solution. When added as a solid, the iodine may be added as solid flakes or as a slurry of solid flakes in a saturated iodine solution or as a slurry of solid flakes in a saturated iodine-hydrogen iodide solution or as a slurry of solid flakes in recycled catholyte liquor. Where the iodine is added in solution, it may be added as a saturated iodine solution, as a saturated solution of hydrogen iodine and iodine or as a solution of hydrogen iodide, unsaturated in iodine.

An electrical current is passed from an anode of the cell through the anolyte liquor, the permionic membrane, and the catholyte liquor to a cathode of the cell, evolving hydrogen iodide in the catholyte. This may be carried out with a current density of from about 0.1 ampere per square centimeter to about 1.0 ampere per square centimeter or even as high as the limiting current density of the electrolyte components. That is, the current density is limited at its upper ranges by the limiting current densities for the permionic membrane, the anode, and the cathode. At the limiting current density, voltage increases will not produce an increase in current density. At its lower ranges, the current density is limited by the economics of the cell design.

The electrolyte temperatures may be from about 15° C. up to about the boiling temperature of the catholyte or anolyte liquor.

The electrolytic cell is shown in the Figure. As there shown, the electrolytic cell 1 has a body 3 with the interior of the cell divided by a permionic membrane 5 into an anolyte chamber having an anode 7 and a catholyte chamber having a cathode 9. The catholyte chamber has iodine feed means 11 which may be used to feed solid iodine directly into the catholyte chamber of the cell 1 through the use of line 13. Alternatively, the iodine feed may be through line 15 to a tank 17 where the iodine is solubilized by the withdrawn aqueous hydrogen iodide solution and thereafter fed into the cell through line 25.

The cell further includes hydroiodic acid recovery line 19 through which product hydroiodic acid can be withdrawn to line 21 and recycle hydroiodic acid can be fed through line 23 to tank 17 there to mix with solid iodine to provide a feed through line 25 to the catholyte chamber of the cell.

Anolyte feed may be through anolyte feed means 27 with coproduct recovery either through line 27 or through a separate recovery line 29.

The anode 7 and anode compartment are preferably fabricated of titanium and titanium alloys such as alloys of titanium with molybdenum, palladium, and yttrium. The body and anode may also be fabricated of lead and lead alloys. According to one exemplification of this invention, the body may be fabricated of glass and have the metal anodes described above.

The cathode and catholyte chamber may be fabricated of stainless steel or lead. The catholyte chamber may further be fabricated of glass and have a metal cathode as described above.

Alternatively, the cell body, including the anode compartment and the cathode compartment, may be fabricated of chlorinated polyvinyl chloride or fiberglass reinforced plastic or fiberglass reinforced chlorendic anhydride type polymers .

In the electrolytic cell used in the practice of this invention, an electrolyte impermeable, ion permeable material, i.e., a permionic membrane, is interposed between the anolyte compartment and the catholyte compartment.

One class of fluorocarbons useful in providing the permionic membranes of this invention are those having the empirical formula;

$$\left(C_mF_{2m}\right)_M\left(CF_2-\underset{\underset{R}{|}}{CF}\right)_N$$

wherein $m$ is from 2 to 10, the ratio of M to N is sufficient to provide an equivalent weight of from 600 to 2,000 as will be more fully elucidated hereinafter, and R is chosen from the group consisting of; A, $$\left(OCF_2-CF_2\right)_pA$$

where $p$ is from 1 to 3, $$\left(OCF_2-\underset{\underset{Y}{|}}{CF}\right)_p A$$

where $p$ is from 1 to 3 and Y is —F or a perfluoroalkyl having from 1 to 10 carbon atoms, $$\left(OCF_2-\underset{\underset{Y}{|}}{CF}\right)_p \left(O-CF_2-\underset{\underset{R_f}{|}}{CF}\right)A$$

where $p$ is from 1 to 3, Y is —F or a perfluoroalkyl having from 1 to 10 carbon atoms, and $R_f$ is —F or a perfluoroalkyl having from 1 to 10 carbon atoms, $$-\phi-A$$

where $\phi$ is an aryl group, and $$(CF_2)_pA$$

where $p$ is from 1 to 3; and where A is an acid group chosen from the group consisting of;

$-SO_3H$,
$-SO_2NH_2$,
$-CF_2SO_3H$,
$-CF_2CO_2NH_2$,
$-CCl_2SO_3H$,
$-CCl_2SO_2NH_2$,
$-\phi'SO_3H$,
$-\phi'SO_2NH_2$,
$-PO_3H_2$,
$-PO_2H_2$,
—COOH, and
$-\phi'OH$
where $\phi'$ is an aryl group.

When the fluorocarbon is one having short side chains, such as poly(perfluoroethylene-trifluorovinyl sulfonic acid) or $(CF_2-CF_2)_M(CF_2-CF(O-CF_2-CF_2SO_3H))_N$, the ratio of M to N, that is, the ratio of the moles of fluorocarbon to the moles of the fluorocarbon acid, is typically about 8, thereby providing an equivalent weight of about 1,000 grams per mole of acid. In the case of such polymers having short side chains, the ratio of M to N is from about 5 to about 20, and preferably from about 6 to about 14. When the ratio of the moles of fluorocarbon to moles of fluorocarbon acid is below about 5, the ion exchange agent shows a decrease in physical strength.

In one preferred exemplification of this invention, the polymer has the empirical formula;

$$(CF_2-CF_2)_M\left(CF_2-\underset{\underset{SO_3H}{|}}{CF}\right)_N$$

where M and N are as described above.

In another exemplification, the polymer has the empirical formula;

$$(CF_2-CF_2)_M\left(CF_2-\underset{\underset{\underset{\underset{\underset{SO_3H}{|}}{CF_2}}{|}}{O}}{CF}\right)_N$$

where M and N are as described as above.

In still another preferred exemplification, the polymer has the empirical formula;

$$(CF_2-CF_2)_M\left(CF_2-\underset{\underset{\underset{\underset{\underset{\underset{\underset{\underset{\underset{SO_3H}{|}}{CF_2}}{|}}{O}}{CFCF_3}}{|}}{O}}{CF}\right)_N$$

While the membrane is spoken of as being a polymer, polyfunctional perfluoroalkyl acids may also be used in preparing membrane according to this invention. Such polyfunctional perfluoroalkyl acids include those having the empirical formula;

$$A(CF_2)_qA'$$

where A and A' are acid groups chosen from the group consisting of;

$-SO_3H$,
$-SO_2NH_2$,
$-CF_2SO_3H$,
$-CF_2SO_2NH_2$,
$CCl_2SO_3H$,
$-CCl_2SO_2NH_2$,
$-\phi'SO_3H$,
$-\phi'SO_2NH_2$,
$-PO_3H_2$,
$-PO_2H_2$,
—COOH, and
$-\phi'OH$
where $\phi'$ is an aryl group, and $q$ is greater than 8. A and A' may be the same acid groups or they may be different acid groups. Most frequently, A is $-SO_3H$ and A' is either a second $-SO_3H$ group, a —COOH group, a $-\phi'SO_3H$ group, a $-SO_2NH_2$group, or a $-\phi'OH$ group. While other combinations of acid groups are useful in providing membranes, they are not as readily available and no significant additional benefit is gained by their use. The length of the perfluoroalkyl unit, $q$, is greater than 8, generally between 8 and 20, and most frequently between 10 and 16. Additionally, ether bonds may be present within the acid, e.g., the formula may be $A-(CF_2)_{q'}-O-(CF_2)_{q''}-A'$ where $q' + q'' = q$. While higher molecular weight perfluoroalkyls may be used, they are not generally commercially available.

When, however, the ion exchange resin is polymeric, the fluorocarbon moiety is a fluorinated olefin such as tetrafluoroethylene, hexafluoropropylene, octafluorobutylene, or further homologues thereof. Tetrafluoroethylene is preferred.

There may also be fluorocarbon moieties present in the interpolymer, having as their precursors fluorinated acetylenes such as difluoroacetylene or fluorinated diolefins such as hexafluorobutadiene. Such fluoroacetylenes and fluorodiolefins may serve as cross-linking agents cross-linking the fluoroolefin polymers and in that way impart additional strength to the diaphragms of this invention.

The acid moiety $$\left(CF_2-\underset{\underset{R}{|}}{CF}\right)$$

may be a fluoroolefin acid such as the trifluoroethylene acids, the pentafluoropropylene acids, the heptafluorobutylene acids, and further homologues thereof. The pendant group may also be a poly(perfluoroether) or poly (perfluoroalkyl) side chain with a terminal acid group. The pendant acid group A is a cation-selective, ion exchange acid group such as a sulfonic ($-SO_3H$), a sulfonamide ($-SO_2NH_2$), a fluoromethylene sulfonic ($-CF_2SO_3H$), a fluoromethylene sulfonamide ($-CF_2SO_2NH_2$), a chloromethylene sulfonic ($-CCl_2SO_3H$), a chloromethylene sulfonamide ($-CCl_2SO_2NH_2$), a benzene sulfonic ($-\phi'SO_3H$), a benzene sulfonamide ($-\phi'SO_2NH_2$), a carboxylic ($-COOH$), a phosphonic ($-PO_3H_2$), a phosphonous ($-PO_2H_2$), or a phenolic ($-\phi'OH$) acid group. When $\phi'$ is used herein, it refers to the aryl group $-C_6H_4-$.

While the preferred acids are the trifluorovinyl acids, both with and without perfluorinated side chains, it is to be understood that other halocarbon acids may be used with entirely satisfactory results.

The preferred acid groups are the sulfonic acid groups including the benzene sulfonic acid group ($-\phi'SO_3H$), the fluoromethylene sulfonic acid group ($-CF_2SO_3H$), the chloromethylene sulfonic acid group ($-CCl_2SO_3H$), the sulfonic acid groups ($-SO_3H$), perfluoro side chains having terminal sulfonic acid groups, and the analogous sulfonamides.

Particularly satisfactory membrane materials are the copolymers of fluoroolefins and trifluorovinyl sulfonic acid. A particularly satisfactory material useful in preparing membranes of this invention is a tetrafluoroethylene and trifluorovinyl sulfonic acid interpolymer, as disclosed, for example, in U.S. Pat. No. 3,624,053 to Gibbs and Griffin for *Trifluorovinyl Sulfonic Acid Polymers.*

While the fluorocarbon described above is illustrated as a polyolefin, it should be noted that other polymeric fluorocarbons may be used with equally satisfactory results. One particularly satisfactory group of materials are the fluorocarbon-fluorocarbon acid vinyl ether polymers, such as those disclosed in U.S. Pat. No. 3,282,875 to Connolly and Gresham for *Fluorocarbon Vinyl Ether Polymers;* British Pat. No. 1,034,197; and German Offenlegungsschrift No. 1,806,097 of D. P. Carlson, based on U.S. application Ser. No. 697,162, filed Oct. 30, 1967. Disclosed by Connolly and Gresham are fluorocarbon-fluorocarbon acid vinyl ether polymers prepared from monomers having the empirical formula;

$$\begin{array}{c} R_f \\ | \\ CF-CF_2-O\left(\begin{array}{c} Y \\ | \\ C \\ | \\ F \end{array}-CF_2-O\right)_n CF=CF_2 \\ | \\ MSO_2 \end{array}$$

where $R_f$ is a radical selected from the group consisting of fluorine and perfluoroalkyl radicals having from 1 to 10 carbon atoms, Y is a radical selected from the group consisting of fluorine and perfluorinated alkyls having from 1 to 10 carbon atoms, *n* is an integer from 1 to 3, and M is a radical selected from the group consisting of fluorine, the hydroxyl radical, the amino radical, and radicals having the formula —OMe where *Me* is a radical selected from the group of alkali metals and the quaternary ammonium radicals.

According to one preferred exemplification, the permionic material is duPont NAFION 390 (TM) which is a multi-layer laminate material. The layer facing the anode is a 4 mil thick layer of 1100 equivalent weight fluorocarbon-fluorocarbon sulfonic acid copolymer, the intermediate layer is a fabric of multi-filament polytetrafluoroethylene fibers on 0.0625 inch centers with equally spaced rayon fibers between each polytetrafluoroethylene fiber, and the layer facing the cathode is a 1.5 mil thick layer of 1500 equivalent weight fluorocarbon-fluorocarbon vinyl sulfonic acid copolymer.

According to still another exemplification of this invention, the permionic membrane has sulfonyl groups on one surface thereof and sulfonamide or sulfonamide salt groups on the opposite side, with the sulfonyl side facing the anolyte and the sulfonamide or sulfonamide salt group facing the acidic catholyte. Such a membrane is described in U.S. Pat. No. 3,784,399 to Grot for *Films of Fluorinated Polymer Containing Sulfonyl Groups With One Surface in the Sulfonamide or Sulfonamide Salt Form and A Process for Preparing Such.*

Alternatively, the membrane may be a permionic material which is degraded by chlorine, such as styrene-divinylbenzene-maleic anhydride.

According to one exemplification of this invention, the process described herein may be carried out in an electrolytic cell having a lead anode and a glass anolyte compartment and a lead cathode and a glass catholyte compartment. The anode and cathode may be separated from each other by a duPont NAFION 390 membrane having one side being a layer of 1.5 mil thick polymer with an equivalent weight of about 1,500 and having the opposite surface being a 4 mil thick polymer with an equivalent weight of about 1,000.

The electrolytic cell may be operated with an anolyte liquor having a 15 weight percent solution of sulfuric acid and an aqueous catholyte liquor of about 13 grams per liter hydrogen iodide, about 13 grams per liter of solubilized iodine, and excess solid iodine in the catholyte. The cell may then be operated at a current density of about 200 amperes per square foot and a voltage of about 3.5 volts to produce a catholyte product containing 55 weight percent aqueous hydrogen iodide solution containing about 0.8 weight percent iodine, substantially no solid iodine, and an anolyte product of oxygen.

EXAMPLE I

Iodine was electrolyzed in the cathode chamber of an electrolytic cell to yield an aqueous hydrogen iodide solution as follows.

The electrolytic cell was fabricated of two glass elbows. Each elbow had a 1.5 inch (3.81 centimeter) diameter by 4 inch (10.16 centimeter) long base and a 1.5 inch (5.08 centimeter) diameter by 3 inch (7.62 centimeter) high portion extending upwardly therefrom. The two elbows were clamped together with a membrane between them. The membrane was a duPont NAFION® 425 perfluoroethylene — [$CF_2$=$CF(OCF_2$—$CF(CF_3))(CF_2CF_2SO_2H)$] copolymer. The membrane was a 5 mil thick film of 1,200 equivalent weight copolymer.

The anode was a 0.5 inch (1.27 centimeter) by 0.625 inch (1.59 centimeter) by 0.125 inch (0.32 centimeter) thick lead sheet. The cathode was a 0.5 inch (1.27 centimeter ) by 0.625 inch (1.59 centimeter) by 0.06 inch (0.16 centimeter) thick titanium 0.02 weight percent yttrium alloy sheet. The anode was spaced 0.5 inch (1.27 centimeter) from the membrane and the cathode was spaced 0.75 inch (1.9 centimeter) from the membrane.

The process was carried out as a batch reaction. The charge to the catholyte compartment was prepared by mixing 14.2 milliliters of 56.3 weight percent aqueous hydroiodic acid, reagent grade, 50.8 grams of solid iodine, and sufficient distilled water to get 500 milliliters of liquid. One hundred twenty milliliters of this composition was then placed in the cathodic chamber of the cell. Solid iodine was observed to be in the catholyte chamber.

The anolyte liquor was 500 milliliters of 15 weight percent aqueous sulfuric acid.

Electrolysis was then commenced at a current density of 460 amperes per square foot (0.495 amperes per square centimeter) and a cell voltage of 4.08 volts. After 1 hour and 53 minutes of electrolysis, the catholyte liquor contained 55 weight percent hydrogen iodide and 1.5 weight percent dissolved iodine.

EXAMPLE II

Iodine was electrolyzed in the cathode chamber of an electrolytic cell to yield an aqueous hydrogen iodide solution as follows.

The electrolytic cell was fabricated of two glass elbows. Each elbow had a 1.5 inch (3.81 centimeter) diameter by 4 inch (10.16 centimeter) long base and a 1.5 inch (3.81 centimeter) diameter by 3 inch (7.62 centimeter) high portion extending upwardly therefrom. The two elbows were clamped together with a membrane between them. The membrane was a duPont NAFION® 425 perfluoroethylene — [$CF_2$—$CF(OCF_2$—$CF(CF_3))(CF_2CF_2SO_2H)$] copolymer. The membrane was a 5 mil thick film of 1,200 equivalent weight copolymer.

The anode was a 0.5 inch (1.27 centimeter) by 0.625 inch (1.59 centimeter) by 0.125 inch (0.32 centimeter) thick lead sheet. The cathode was a 0.5 inch (1.27 centimeter) by 0.625 inch (1.59 centimeter) by 0.125 inch (0.32 centimeter) thick lead sheet. The anode was spaced 0.75 inch (1.9 centimeter) from the membrane and the cathode was spaced 0.50 inch (1.27 centimeter) from the membrane.

The process was carried out as a batch reaction. The charge to the catholyte compartment was 120 milliliters of the iodine-hydrogen iodide aqueous solution prepared in Example I above. One hundred twenty milliliters of this composition was then placed in the catholyte chamber of the cell. Solid iodine was observed to be in the catholyte chamber.

The anolyte liquor was 120 milliliters of 15 weight percent aqueous sulfuric acid.

Electrolysis was then commenced at a current density of 460 amperes per square foot (0.495 amperes per square centimeter) and a cell voltage of 4.25 volts. After 2 hours of electrolysis, the catholyte liquor contained 55 weight percent hydrogen iodide and 0.8 weight percent dissolved iodine.

EXAMPLE III

Iodine was electrolyzed in the cathode chamber of an electrolytic cell to yield an aqueous hydrogen iodide solution as follows.

The electrolytic cell was fabricated of two glass elbows. Each elbow had a 1.5 inch (3.81 centimeter) diameter by 4 inch (10.16 centimeter) long base and a 1.5 inch (3.81 centimeter) diameter by 3 inch (7.62 centimeter) high portion extending upwardly therefrom. The two elbows were clamped together with a membrane between them. The membrane was a duPont NAFION® 425 perfluoroethylene — [$CF_2$=$CF(OCF_2$—$CF(CF_3))(CF_2CF_2SO_2H)$] copolymer. The membrane was a 5 mil thick layer of 1,200 equivalent weight copolymer.

The anode was a 0.5 inch (1.27 centimeter) by 0.625 inch (1.59 centimeter) by 0.125 inch (0.32 centimeter) thick lead sheet. The cathode was a 0.5 inch (1.27 centimeter) by 0.625 inch (1.59 centimeter) by 0.125 inch (0.32 centimeter) thick lead sheet. The anode to cathode gap was 1.25 inch (3.18 centimeter).

The process was carried out as a semi-batch reaction. The initial charge to the catholyte compartment was 120 milliliters of the hydrogen iodide-iodine composition prepared in Example I above.

The following results were obtained over the course of an extended test:

| Time After Cell Start Up Hours-Minutes | Voltage (Volts) | Current Density (Amperes per square foot) | Catholyte Addition | Anolyte Addition |
|---|---|---|---|---|
| 00:00 | 5.61[1] | 460 | 120 ml solution | 120 ml solution |
| 02:10 | 4.97[2] | 460 | 4.26 grams solid $I_2$ | |
| 04:16 | 4.16[3] | 460 | 1.98 grams solid $I_2$ | |
| 05:28 | — | 446[4] | 5.30 grams solid $I_2$ | |
| 06:03 | 2.48[5] | 46[4] | | 30 ml solution |
| 21:33 | 4.03 | 460 | 4.61 grams solid $I_2$ | |
| 23:23 | — | 460 | 4.74 grams solid $I_2$ | |
| 25:33 | 3.71 | 460 | 5.03 grams solid $I_2$ | |
| 27:03 | 3.89–3.56[6] | 460 | 4.72 grams solid $I_2$ | |
| 28:09 | 3.79–3.40[6] | 460 | 4.89 grams solid $I_2$ | |
| 29:25 | 3.69–3.34[6] | 460 | 8.04 grams solid $I_2$ | |
| 29:53 | 3.39–2.51[7] | 460–46[7] | — | |
| 45:27 | 2.91–3.92[8] | 55–460[8] | — | |
| | 3.92–3.55[6] | 460 | 8.85 grams solid $I_2$ | |
| 47:30 | 3.62–3.29[6] | 460 | 11.29 grams solid $I_2$ | |
| 49:56 | 3.54–3.24[6] | 460 | 10.93 grams solid $I_2$ | |
| 52:23 | 3.50–3.24[6] | 460 | 15.83 grams solid $I_2$ | |
| 54:15 | 3.37–3.34[6] | 460 | 10.49 grams solid $I_2$ | |
| 54:18 | 3.34–2.59[7] | 460–46[7] | — | |

-continued

| Time After Cell Start Up Hours-Minutes | Voltage (Volts) | Current Density (Amperes per square foot) | Catholyte Addition | Anolyte Addition |
|---|---|---|---|---|
| 69:49 | 2.65–3.27[8] | 45–460[8] | — | |

[1]Voltage at 1¼ inch anode to cathode gap.
[2]Voltage at 1¼ inch anode to cathode gap, voltage was reduced to 4.05 volts by moving the electrodes closer together (approximately 1 inch interelectrode gap).
[3]Voltage at 1 inch. Voltage dropped to 4.10 volts shortly after addition of iodine to the catholyte.
[4]Current density reduced from 446 amperes per square foot to 46 amperes per square foot after 5 hours and 28 minutes of operation.
[5]Cell voltage dropped to 2.48 volts upon addition of sulfuric acid to anolyte and then increased to 3.02 volts.
[6] Cell voltage dropped after addition of solid iodine to catholyte liquor.
[7]Reduced current density to 46 amperes per square foot.
[8]Increased current density to 460 amperes per square foot.

The total amount of iodine charged to the catholyte was 91.1876 grams. The initial charge of catholyte liquor contained 11.1 grams of hydrogen iodide. The final catholyte product contained 463.3 grams per liter of hydrogen iodide and 0.3 weight percent iodine. The amount of catholyte formed was 189.5 milliliters. The iodine accountability was approximately 94 percent.

The total current to the cell was 26.9 ampere hours. The cathode current efficiency was approximately 68 percent.

EXAMPLE IV

Iodine was electrolyzed in the cathode chamber of an electrolytic cell to yield an aqueous hydrogen iodide solution as follows.

The electrolytic cell was fabricated of two glass elbows. Each elbow had a 1.5 inch (3.81 centimeter) diameter by 4 inch (10.16 centimeter) long base and a 1.5 inch (3.81 centimeter) diameter by 3 inch (7.62 centimeter) high portion extending upwardly therefrom. The two elbows were clamped together with a membrane between them. The membrane was a duPont NAFION® 390 perfluoroethylene — $[CF_2{=}CF(OCF_2{-}CF(CF_3))(CF_2CF_2SO_2H)]$ copolymer. The membrane had a 4 mil thick layer of 1,100 equivalent weight copolymer facing the anolyte and a 1.5 mil thick layer of 1,500 equivalent weight copolymer facing the catholyte.

The anode was a 0.5 inch (1.27 centimeter) by 0.625 inch (1.59 centimeter) by 0.06 inch (0.15 centimeter) thick lead sheet. The cathode was a 0.05 inch (1.27 centimeter) by 0.625 inch (1.59 centimeter) by 0.06 inch (0.15 centimeter) thick Grade 316 stainless steel sheet. The anode was spaced 0.5 inch (1.27 centimeter) from the cathode.

The process was carried out as a batch reaction. The charge to the catholyte compartment was prepared by mixing 100 milliliters of 39 weight percent aqueous hydroiodic acid, reagent grade, and 20.0 grams of solid iodine. This composition was then placed in the catholyte chamber of the cell. Solid iodine was observed to be in the catholyte chamber.

The anolyte liquor was 100 milliliters of 15 weight percent aqueous sulfuric acid.

Electrolysis was then commenced at a current density of 144 amperes per square foot and a cell voltage of 3.77 volts. After 3 hours and 5 minutes of electrolysis with water transport through the membrane from the anolyte to be catholyte, the catholyte liquor contained 40.4 weight percent hydrogen iodide and 0.03 weight percent dissolved iodine.

EXAMPLE V

Iodine was electrolyzed in the cathode chamber of an electrolytic cell to yield an aqueous hydrogen iodide solution.

The electrolytic cell was fabricated of two glass elbows. Each elbow had a 1.5 inch (3.81 centimeter) diameter by 4 inch (10.16 centimeter) long base and a 1.5 inch (3.81 centimeter) diameter by 3 inch (7.62 centimeter) high portion extending upwardly therefrom. The two elbows were clamped together with a membrane between them. The membrane was a duPont NAFION® 390 perfluoroethylene — $[CF_2{=}CF(OCF_2{-}CF(CF_3))(CF_2CF_2SO_2H)]$ copolymer. The membrane had a 4 mil thick layer of 1,100 equivalent weight copolymer facing the anolyte and a 1.5 mil thick layer of 1,500 equivalent weight copolymer facing the catholyte.

The anode was a 0.50 inch (1.27 centimeter) by 0.625 inch (1.59 centimeter) by 0.06 inch (0.15 centimeter) thick lead sheet. The cathode was a 1.25 inch (3.18 centimeter) diameter by 0.06 inch (0.15 centimeter) thick perforated steel disc sheet. The anode was spaced 0.5 inch (1.27 centimeter) from the cathode.

The process was carried out as a batch reaction. The charge to the catholyte compartment was prepared by mixing 100 milliliters of 40 weight percent aqueous hydroiodic acid, reagent grade, and 20 grams of solid iodine. The composition was then placed in the catholyte chamber of the cell. Solid iodine was observed to be in the catholyte chamber.

The anolyte liquor was 100 milliliters of 30 weight percent aqueous sulfuric acid.

Electrolysis was then commenced at a current density of 206 amperes per square foot and a cell voltage of 3.78 volts. After 3 hours of electrolysis, the catholyte liquor contained 42.2 weight percent hydrogen iodide and 0.02 weight percent dissolved iodine. There was observed to be less water transport than in Example IV.

While the invention has been described with respect to certain exemplifications and embodiments thereof, the scope is not to be so limited except as in the appended claims.

I claim:

1. A method of producing hydrogen iodide comprising the steps of:

providing an aqueous catholyte liquor containing a solubilizing amount of hydrogen iodide;

providing an electrically conductive anolyte liquor;

feeding iodine to the catholyte liquor; and passing an electrical current from an anode through said anolyte liquor and catholyte liquor to a cathode whereby to evolve hydrogen iodide.

2. The method of claim 1 wherein said anolyte liquor is an aqueous acid.

3. The method of claim 1 wherein said catholyte liquor contains at least 1.0 gram per liter of hydrogen iodide.

4. The method of claim 1 comprising maintaining a cation selective permionic membrane between the anolyte liquor and the catholyte liquor.

5. The method of claim 1 comprising feeding solid iodine to the catholyte.

6. A method of producing hydrogen iodide comprising the steps of:

providing an aqueous catholyte liquor containing iodine;

providing an electrically conductive anolyte liquor separated from said catholyte by a permionic membrane; and passing an electrical current from an anode through said anolyte liquor and catholyte liquor to a cathode whereby to evolve hydrogen iodide.

7. The method of claim 6 wherein said anolyte liquor is an aqueous acid.

8. The method of claim 6 wherein said catholyte liquor contains a solubilizing amount of hydrogen iodide.

9. A method of producing hydrogen hydrogen iodide comprising passing an electrical current through an aqueous anolyte liquor to an aqueous catholyte liquor which catholyte liquor contains iodine.

10. The method of claim 9 wherein said anolyte liquor is separated from said catholyte liquor by a permionic membrane.

11. The method of claim 9 wherein said anolyte liquor is an aqueous acid.

12. The method of claim 9 wherein said catholyte liquor contains hydrogen iodide.

* * * * *

UNITED STATES PATENT AND TRADEMARK OFFICE

CERTIFICATE OF CORRECTION

PATENT NO. : 4,053,376

DATED : October 11, 1977

INVENTOR(S) : William W. Carlin

It is certified that error appears in the above-identified patent and that said Letters Patent are hereby corrected as shown below:

Column 14, line 1, the first "hydrogen" should be cancelled.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*